US007498594B2

(12) United States Patent
Georgii

(10) Patent No.: US 7,498,594 B2
(45) Date of Patent: Mar. 3, 2009

(54) CONTAINER DEVICE FOR THE STORAGE OF HAZARDOUS MATERIAL, PARTICULARLY FOR THE ULTIMATE DISPOSAL OF NUCLEAR FUEL, AND INSTALLATION FOR MANUFACTURING IT

(75) Inventor: Hans Georgii, London (GB)

(73) Assignee: Oyster International N.V., Curacao (AN)

( * ) Notice: Subject to any disclaimer, the term of this patent is extended or adjusted under 35 U.S.C. 154(b) by 425 days.

(21) Appl. No.: 10/536,737

(22) PCT Filed: Nov. 28, 2003

(86) PCT No.: PCT/SE03/01837

§ 371 (c)(1),
(2), (4) Date: May 27, 2005

(87) PCT Pub. No.: WO2004/051671

PCT Pub. Date: Jun. 17, 2004

(65) Prior Publication Data

US 2006/0021981 A1 Feb. 2, 2006

(30) Foreign Application Priority Data

Nov. 29, 2002 (SE) ..... 0203528

(51) Int. Cl.
*G21F 5/00* (2006.01)

(52) U.S. Cl. ..... 250/506.1; 250/505.1; 250/507.1; 250/517.1

(58) Field of Classification Search .... 250/505.1–519.1
See application file for complete search history.

(56) References Cited

U.S. PATENT DOCUMENTS 4,123,392 A * 10/1978 Hall et al. ..... 252/478

(Continued)

FOREIGN PATENT DOCUMENTS

WO WO 98/16936 4/1998

*Primary Examiner*—Jack I Berman
*Assistant Examiner*—Andrew Smyth
(74) *Attorney, Agent, or Firm*—Stites & Harbison PLLC; Douglas E. Jackson

(57) ABSTRACT

A container device (11) for the long-term storage of hazardous material, particularly for the ultimate disposal of nuclear fuel, comprises at least one elongate, cylindrical first containment body (A) having walls defining a first compartment (14) for accommodating at least one hazardous-material body (F) formed by the hazardous material or containing or supporting the hazardous material. The first compartment (14) comprises support means for supporting the hazardous-material body centrally in the first compartment and spaced from the walls thereof. The container device also comprises an elongate, cylindrical second containment body (B) having walls defining a cylindrical second compartment (22). The second compartment (22) comprises support means for supporting the first containment body (A) centrally in the second containment body (B) and spaced from the walls thereof. Passages are provided in at least one end wall of each of the first and second containment bodies for the introduction of wet concrete in respectively the first compartment (14) and the second compartment (22).

12 Claims, 5 Drawing Sheets

U.S. PATENT DOCUMENTS 4,727,257 A * 2/1988 Grifoni ..... 250/518.1
5,140,165 A * 8/1992 Kiuchi et al. ..... 250/506.1
5,327,469 A 7/1994 Georgii
5,545,796 A * 8/1996 Roy et al. ..... 588/4
5,789,648 A * 8/1998 Roy et al. ..... 588/1
6,008,428 A 12/1999 Georgii
6,696,695 B1 2/2004 Georgii
6,785,355 B2 8/2004 Georgii

* cited by examiner

CONTAINER DEVICE FOR THE STORAGE OF HAZARDOUS MATERIAL, PARTICULARLY FOR THE ULTIMATE DISPOSAL OF NUCLEAR FUEL, AND INSTALLATION FOR MANUFACTURING IT

This invention relates to a container device for the long-term storage of hazardous materials. In particular, the type of hazardous material contemplated is nuclear fuel or other radioactive materials that retain a high activity level for very long times and have to be stored in a safe manner at least until the activity has fallen to a level which is not dangerous. For that reason, the invention will be described with particular reference to its application to the ultimate disposal of spent nuclear fuel. However, the applicability of the invention is not limited to any particular type of hazardous material. Other types of hazardous material that may be contemplated are nuclear weapons or parts of such weapons, war gases, extremely hazardous biological materials, etc.

Container devices for the ultimate disposal of nuclear fuel have to meet requirements which are much more stringent in several respects than the requirements which are applicable to shipping containers or other containers for the short-term storage of nuclear fuel. While container devices of the last-mentioned category have to admit of safe storage for periods of time which may be several decades, container devices for the ultimate storage have to be safe for substantially longer periods of time, such us several centuries or even thousands of years. For example, in a current research and development project aiming at creating an ultimate repository in the state of Nevada in the United States, a prerequisite is that the storage of the radioactive material must be safe for tens of thousands of years.

Among the requirements to be met is that which requires the container devices to withstand extreme mechanical loads, both short and long-term static and dynamic loads and chock loads, such as loads that can occur as a result of earthquakes and other seismic movements or in connection with nuclear detonations or other war or terrorist operations. Other requirements to be met are those which call for extremely long-term stability, such as resistance to corrosion or other decomposition or ageing phenomena, even under the influence of heating caused by the contained nuclear fuel, occurring in the materials of the container devices, or at least the material of parts whose failure compromise the safety.

An object of the invention is to provide a container device that is suitable for the ultimate disposal of nuclear fuel and can be expected to offer a fully reliable containment of stored nuclear fuel throughout the period of time for which that material is to be regarded as a hazardous material.

To that end the invention provides the container device that is set forth in the independent claim. Preferred and advantageous embodiments of the device are set forth in the dependent claims.

As will be apparent from the following description of the invention, the container device according to the invention comprises certain elements which are prior art in respect of storage of nuclear fuel or other highly hazardous materials, such as the prior art disclosed in WO91/05351 (or U.S. Pat. No. 5,327,469) and WO96/21932 (or U.S. Pat. No. 6,008,428). However, it will become apparent that the container device is nevertheless non-obvious over the prior art.

The invention also relates to a method and an installation for making container devices according to the invention.

A feature of the container device according to the invention which is essential for the achievement of the stated object resides in a kind of box-in-box construction of the finished, sealed container device in which a number of concrete barriers alternate with metal barriers between the nuclear fuel and the outer side of the container device. Basically, the number of such barriers can be unlimited and selected in accordance with the desired degree of safety. If a barrier should become damaged by force or corrosion or fail for some other reason, other barriers remain to prevent nuclear material from coming out of the container.

An embodiment of the container device according to the invention and a method and an installation for making it will be described below with reference to the accompanying drawings.

Figure 1:
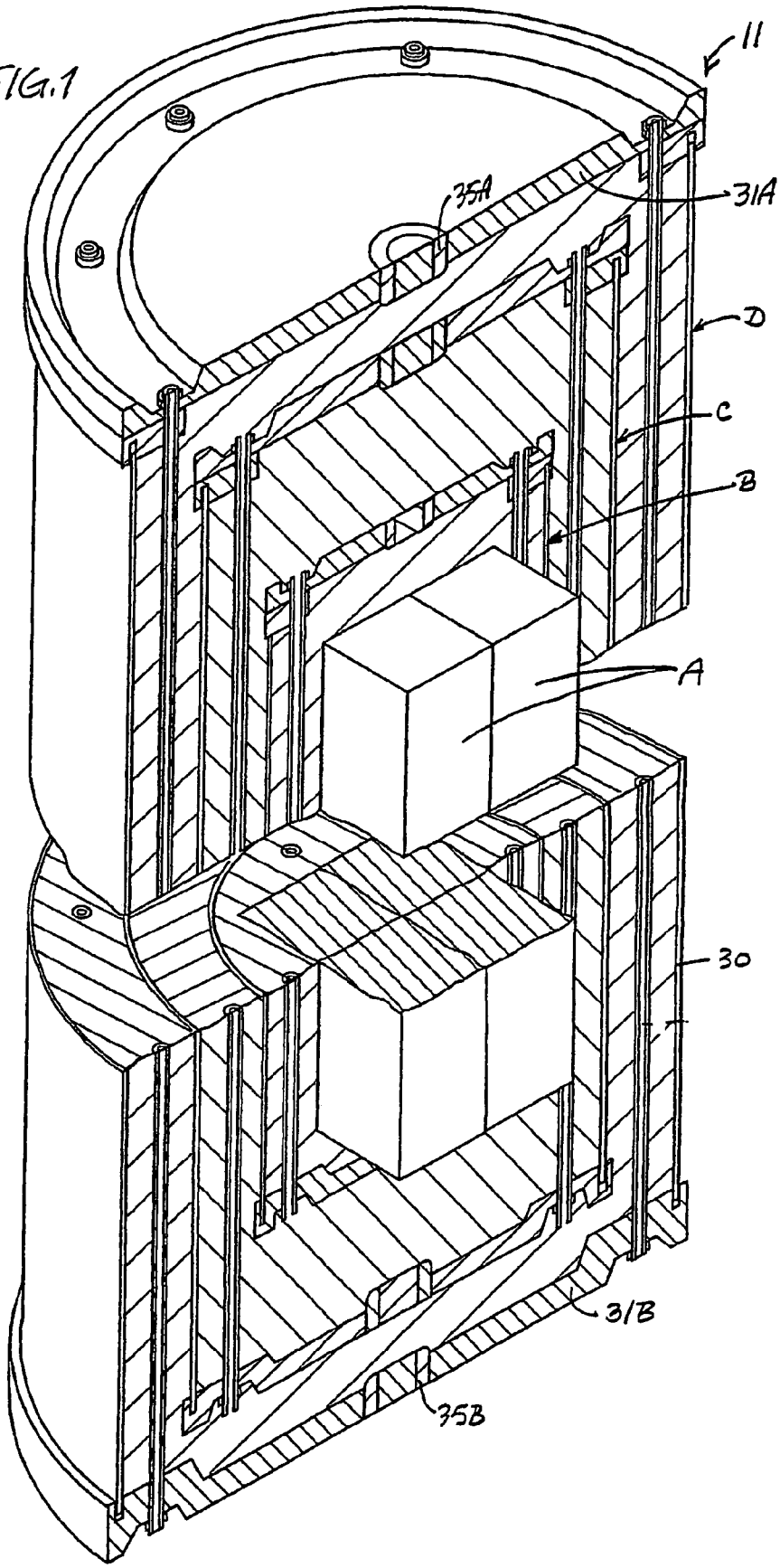
FIG. 1 is a perspective view in vertical section of a completed container device according to the invention.

The following description, including the drawing figures, of the container device of the invention and of the method and the installation for making it is limited to what is essential for the understanding of the invention. As is readily appreciated, the implementation of the invention requires a good deal of matter that is not illustrated or described, but the person skilled in the art, guided by the description that follows, can add what is lacking merely by exercising his skill.

Figure 5:
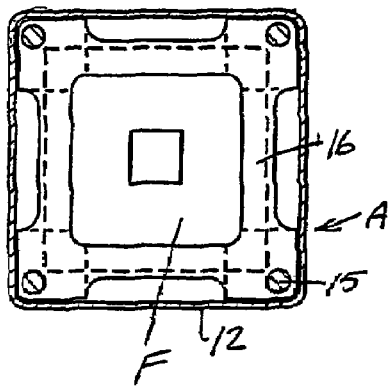
FIG. 5 shows the containment body of FIG. 4 as viewed in cross-section on line V-V.
Figure 4:
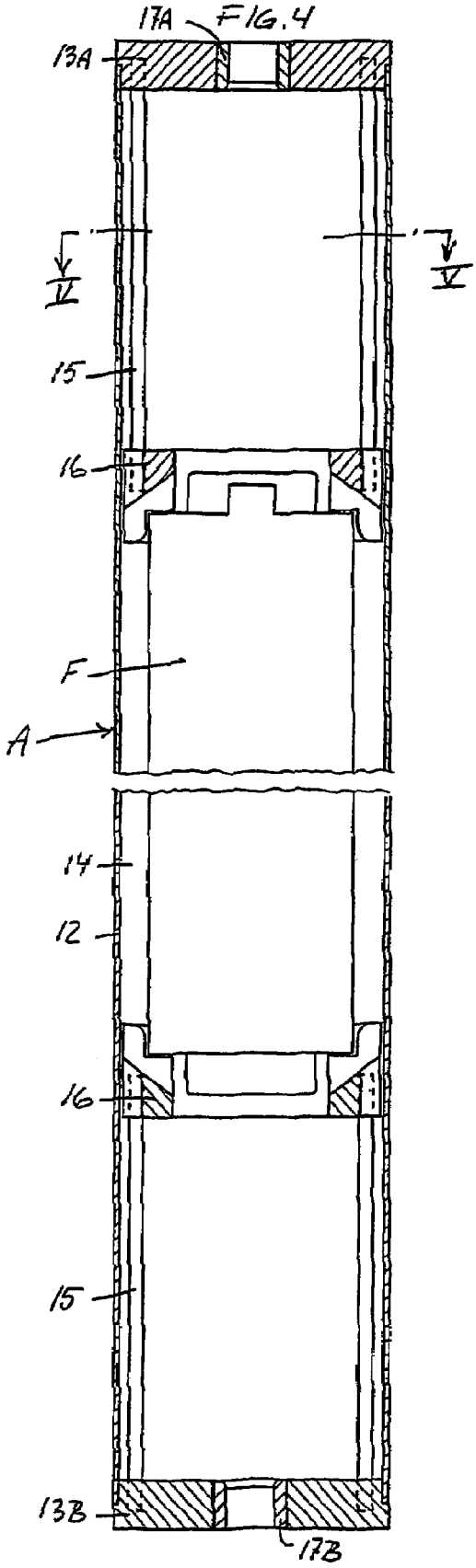
FIG. 4 is an axial sectional view of one out of four identical inner or first containment bodies, each such body containing a nuclear fuel assembly and forming a central or inner part of the container device.

The container device 11 illustrated in the drawings is adapted to contain four identical nuclear-fuel bodies formed by nuclear-fuel assemblies. FIGS. 4 and 5 diagrammatically show the outlines of such a fuel assembly F. The fuel assemblies F are nuclear fuel units each containing a set of fuel rods (not shown) in which the nuclear fuel proper is enclosed. Naturally, the number of nuclear-fuel assemblies can be different from that in the illustrated exemplary embodiment.

Each fuel assembly F is enclosed in a first sub-container or containment body A which is in the shape of an elongate cylindrical body of square cross-section (naturally, the cross-section may alternatively be round or of a different non-square shape) and comprises a casing wall 12 of sheet metal and end walls 13A and 13B formed respectively of an upper metal plate and a lower metal plate. In the compartment 14 formed by the casing wall 12 and the end walls 13A, 13B rods 15 are secured to each end wall to carry support members 16 at a distance from the end walls. These support members hold between them the nuclear-fuel assembly F such that there is an open space between the fuel assembly and the inner side of the casing wall 14.

Each of the two end walls 13A, 13B has a central opening formed by a sleeve 17A, 17B. These sleeves are schematic representations of means not shown in detail which are used for the introduction of a casting compound—this casting compound may be glass or concrete and is here assumed to be the latter kind of casting compound—into the open space in the compartment 14 after the fuel assembly F has been mounted in the compartment. The concrete may be forced through opening in the ends of the fuel assembly and/or its sides and fill the open spaces of the fuel assembly such that the fuel rods will also be surrounded by concrete. Such means may comprise a valve through which the concrete is introduced and a valve through which excess concrete is forced out of the containment body A. This valve may be adapted to open only after a certain pressure exists in the compartment such that the concrete will have to be supplied under a given pressure.

Figure 7:
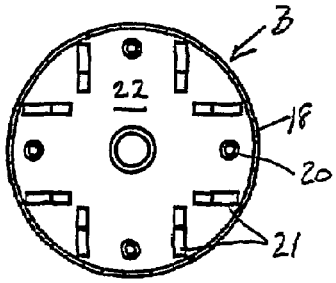
FIG. 7 shows the containment body of FIG. 6 as viewed in cross-section on line VII-VII.
Figure 9:
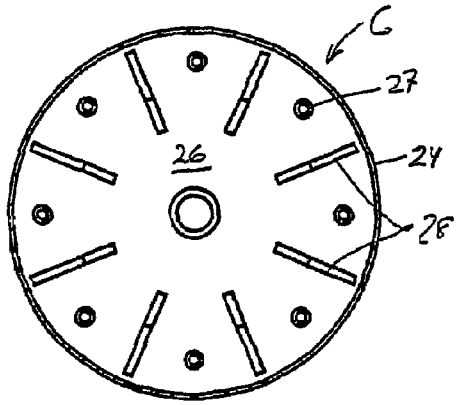
FIG. 9 shows the containment body of FIG. 8 as viewed in cross-section on line IX-IX.

In the completed container device the first containment body A is surrounded by a second sub-container or containment body B. This containment body is in the shape of an elongate cylindrical body of circular cross-section and comprises a casing wall 18 of sheet metal and end walls 19A and 19B formed of a lower end plate and an upper end plate, respectively. Slightly inwardly of the casing wall a number of perforated tubes 20 are anchored in the end walls 19A, 19B to serve as prestressed reinforcing members 20. In FIG. 7, four such tubes 20 are shown but the number of tubes can be different, such as eight.

Figure 3:
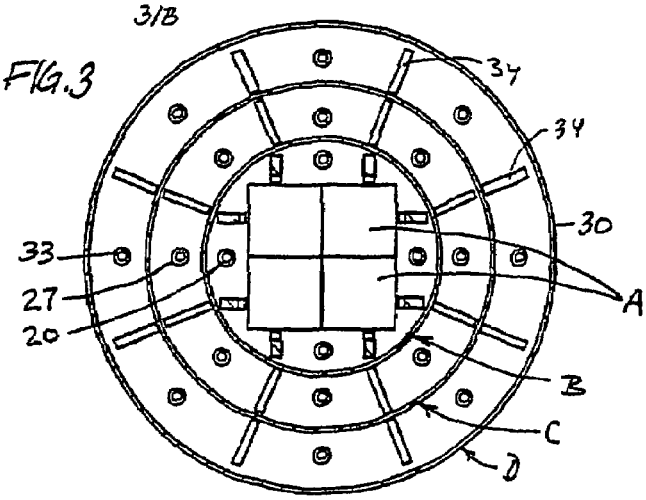
FIG. 3 shows the container device in cross-section on line III-III in FIG. 2.
Figure 6:
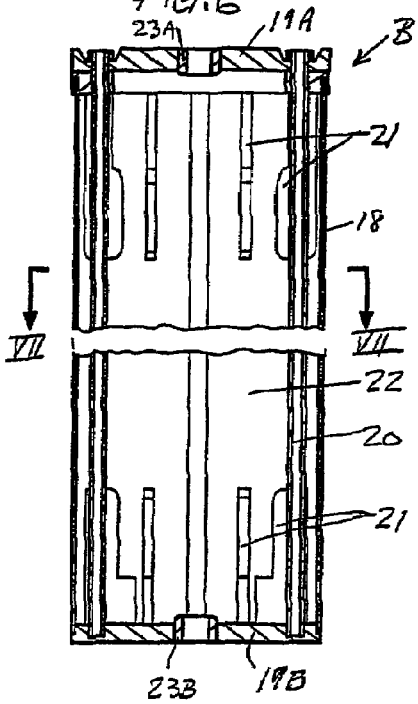
FIG. 6 is an axial sectional view of a second containment body enclosing the first containment body.
Figure 8:
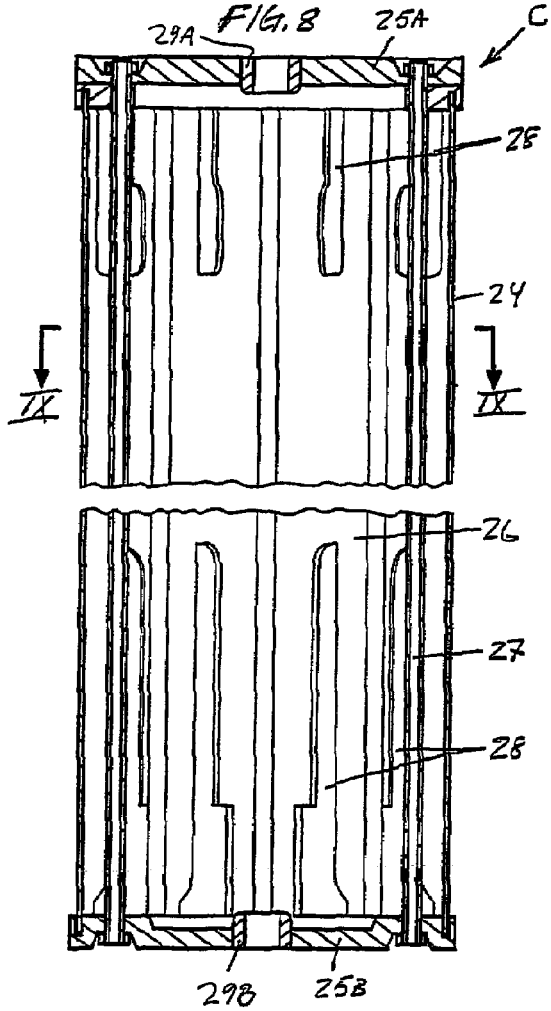
FIG. 8 is an axial sectional view of the second containment body.

To each of the end walls 19A, 19B eight support members 21 (see particularly FIGS. 6 and 7) are secured to retain the first four containment bodies A in the compartment 22 defined by the casing wall 18 and the end walls 19A, 19B such that these containment bodies are jointly fixed in an axially and radially centred position relative to the second containment body B with a spacing relative to both the casing wall 18 and the end walls 19A, 19B as is best seen in FIG. 3. The space defined by the casing wall 18 and the end walls 19A, 19B that thus exists between the first containment body A and the second containment body B is considerably larger than the corresponding space in the first containment bodies, and like the latter space it is completely filled with concrete in the finished container device 11. The walls of the hollow cylindrical concrete body that encloses the first containment bodies A within the completed container device thus are substantially thicker than the walls of the concrete body that encloses the fuel assemblies in the first containment bodies A.

In a corresponding manner and for the same purpose as the end walls 13A, 13B of the first containment bodies A, the end walls 19A, 19B are each provided with a central opening formed by a sleeve 23A, 23B.

The second containment body B is enclosed by a third containment body C which is constructed in substantially the same manner as the containment body B. Thus, the containment body C comprises a circular cylindrical casing wall 24 and upper and lower end walls 25A, 25B. These walls define a compartment 26 which houses perforated axial tubes 27 which are anchored in the end walls to serve as pre-stressed reinforcing members. In this case the number of tubes 27 is eight. To each of the end walls 25A, 25B eight support members 28 are secured to retain the second containment body B in a radially and axially centred position in the compartment 26. The space that exists in the compartment 26 between the second containment body B and the third containment body C is filled with concrete in the completed container device. To permit the filling with concrete, the end walls 25A, 25B are provided with central openings formed by sleeves 29*a*, 29B similar to the sleeves 23A, 23B.

In the illustrated embodiment there is also a fourth containment body D in which the third containment body C is enclosed in a radially and axially centred position and which is substantially identical with the containment body C apart from the dimensions. Accordingly, the containment body D comprises a circular cylindrical casing wall 30 and upper and lower end walls 31A, 31B. These walls define a compartment 32 which houses perforated axial tubes 33 anchored in the end walls to serve as pre-stressed reinforcing members. In this case as well, the number of tubes 33 is eight. To each of the end walls 31A, 31B eight support members 34 (shown only in FIG. 3) are secured to retain the third containment body C in a radially and axially centred position in the compartment 32. The space in the compartment that is formed between the third containment body C and the fourth containment body D is filled with concrete in the completed container device. To permit the filing with concrete the end walls 31A, 31B have central openings formed by sleeves 35A, 35B similar to the sleeves 23A, 23B and 29A, 29B.

As will be appreciated, the drawing figures show the container device according to the invention in simplified form and with omission of many details which form no part of the invention and do not have to be illustrated and described to enable the person skilled in the art to carry out the invention. For example, as a practical matter, the sub-containers or containment bodies A to D have to be provided with auxiliary elements enabling lifting and other manipulations of them, possibly also measuring or monitoring devices.

Figure 2:
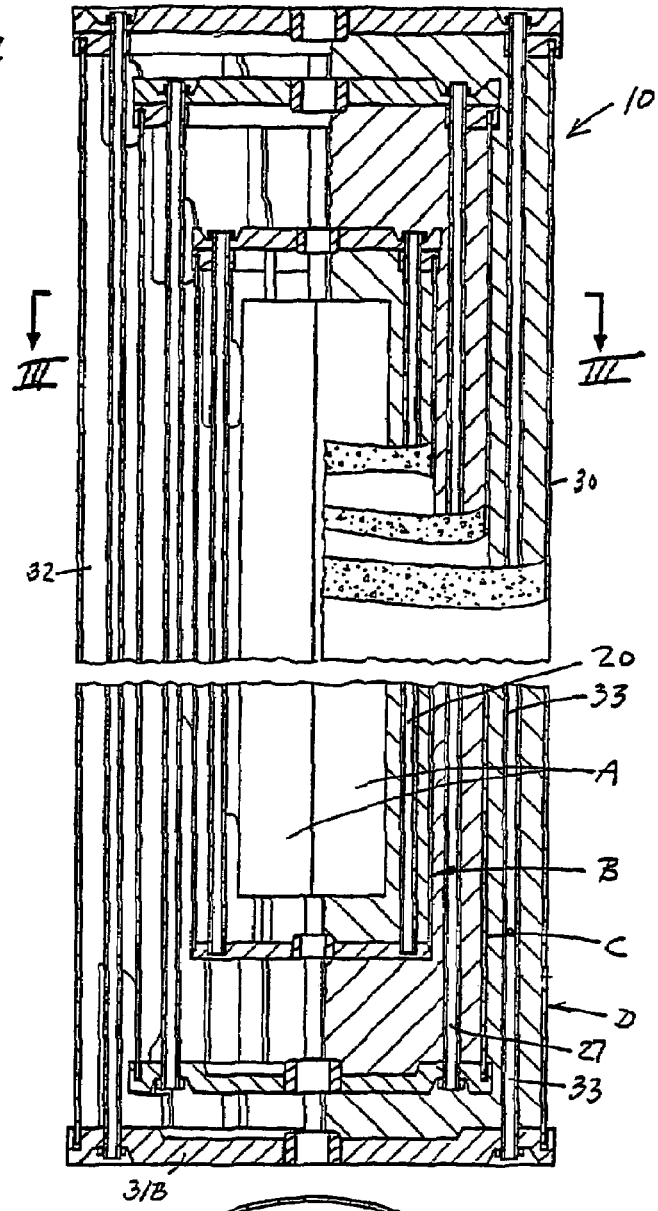
FIG. 2 shows the container device for the most part in vertical axial section but partly in elevation, namely to the right in the upper part, the left part of the figure showing the container device with the concrete omitted.
Figure 10:
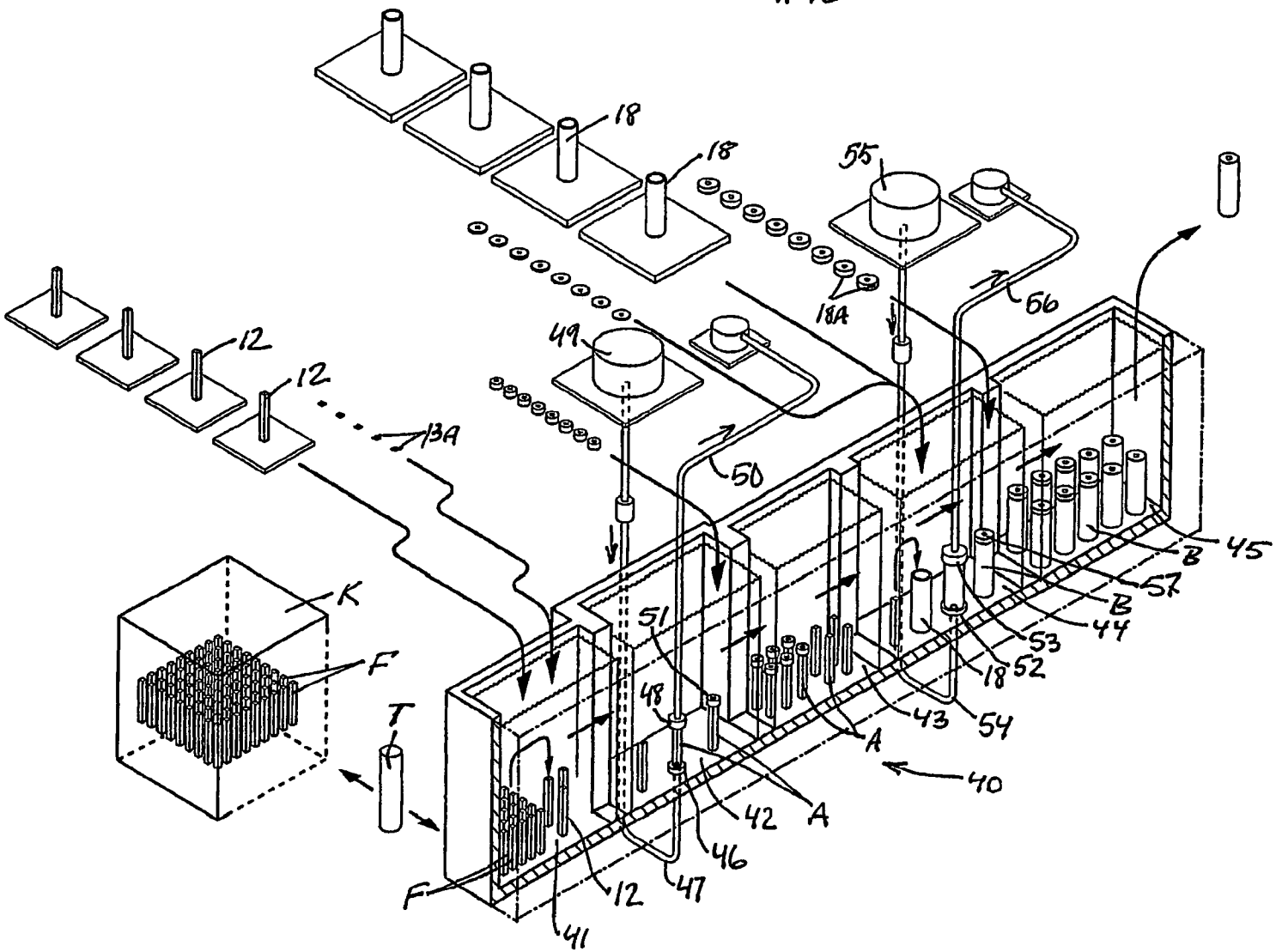
FIG. 10 is a diagrammatic perspective view of an installation for making the container device shown in FIGS. 1 to 3.

An overview of an installation and a method for manufacturing the container device according to the invention is shown in FIG. 10. To simplify the illustration, only so much of the installation is shown as is necessary for manufacturing a container device comprising the containment devices A and B in FIGS. 1 to 3. However, the illustrated installation can readily be expanded to be useful for manufacturing container devices which also comprise the containment body C or the containment bodies C and D.

As shown schematically in FIG. 10 the installation resembles the installation disclosed in WO01/78084 A1, e.g. in that the manufacture is carried out under water in a basin system with a number of concrete sections, but it also has important differences over that installation in respect of the means and the method for the manufacture.

A main part of the installation comprises a basin 40 with a row of basin sections 41, 42, 43, 44, 45. Adjacent basin sections can be connected with and disconnected from one another by means of water gates such that components of the container devices and the container devices themselves can be transferred in a submerged position from one basin section to the next.

Nuclear fuel units, formed by fuel assemblies F in the illustrated example, which are to be contained in container devices according to the invention and are stored in, for example, a central temporary storage K for spent nuclear fuel, are transferred to the basin 40 in a shipping container T. They are transferred from the shipping container T to the first basin section 41 in which they are placed in a submerged position. Main components of the first sub-container or containment body A (FIGS. 4, 5) are also transferred to the first basin section. These components are, firstly, a unit formed by the casing wall 12, the lower end wall 13B, which is connected to the casing member and has the lower rods 15 and the lower support member 16 attached to it, and, secondly, the upper end wall 13A, the upper rods 15 and the upper support member 16. In FIG. 10, the first-mentioned elements are represented by the casing wall 12 and the last-mentioned elements are represented by the upper end wall 13A.

The aforesaid unit is placed under water in the basin section, optionally positioned in a holder that contributes to firmly retaining the unit in an upright position. A fuel assembly F is placed in each unit whereupon the upper support member 16, the rods 15 and the upper end wall 13A are attached.

Then the unit so formed, which does not yet constitute the finished containment body A, is transferred, still submerged, to the second basin section 42 where it is filled with concrete to form a body which is monolithic in the sense that it is essentially free from voids.

In the second basin section 42 the containment body A is positioned on a casting platform 46 which is mounted on the bottom of the basin section and connected to a concrete supply line 47. A casting head 48 is mounted on the upper end of the containment body. Concrete (casting compound) is supplied at a high pressure, preferably several decabar, from a concrete station 49 to the casting platform 46 and axially through the containment body A so that the containment body is completely filled with concrete at a high pressure. Excess concrete is carried away through a discharge line 50.

When the containment body a is filled with concrete, the nuclear fuel rods in the fuel assembly will also be embedded in concrete. Thus, the fuel rods will be well protected against cracling or other damages during the handling of the fuel assemblies or the container device and for practical purposes also against attempts at getting access to the nuclear fuel for illegal or otherwise undesired use of the stored nuclear fuel. In addition, the protection against leakage from the fuel rods is improved.

When the casting is completed, the openings of the sleeves 18A, 18B in the end walls 13*a*, 13B through which the concrete is forced into the containment body and excess concrete is discharged will also be filled with concrete so that the finished containment body will be completely sealed.

After completion of the casting an auxiliary device 51 is mounted on the upper end of the finished containment body A to facilitate manipulation thereof. The concrete in the containment body is allowed to set for a suitable period in the basin section 43 before it is transferred to the next basin section 44 where the containment body B will be made.

Broadly, the containment body B is made as described with reference to the containment body A. The containment bodies A are transferred to the basin section 44 where they are united with the separately made main components of the containment body B, that is, a unit which is essentially formed by the casing wall 18, the lower end wall 19B, the tubes 20 and the lower set of support members 21, and the upper end wall 19A and the upper set of support members 21. In FIG. 10, the first-mentioned elements are represented by the casing wall 18 and the last-mentioned elements are represented by the upper end wall 19A.

In the basin section 44 the four containment bodies A are inserted in the above-mentioned unit, represented by the casing wall 18, whereupon the upper end wall 19A is attached and the reinforcing tubes 20 are tensioned. Filling of the space around the four containment bodies A within the containment body B with concrete at a high pressure, e.g. 10 to 50 bar, by means of a casting platform 52 mounted on the bottom of the basin section and a casting head 53, then takes place in substantially the same manner as the filling of the containment bodies A with concrete. The concrete is pumped through a concrete supply line 54 from a concrete station 55 and excess concrete is carried away through a discharge line 56. As was the case when the containment body A was filled, the openings of the end wall sleeves 23A, 23B through which the concrete is supplied and excess concrete is discharged will be filled with concrete when the casting operation is completed, see FIG. 1. The high concrete pressure contributes to the pre-tensioning of the tubes 20.

When the casting is completed, an auxiliary device 57 is attached to the upper end of the completed containment body B to facilitate manipulation thereof. The concrete in the containment body B is allowed to set for a suitable period in the basin section 44 or in the next basin section 45 before it is carried away, e.g. to an ultimate storage. In the final phase of the casting the concrete can be subjected to a vacuum treatment with the aid of the tubes 20 which can then be filled with concrete.

If the container device is also to comprise the containment body C, the procedure described above is repeated, either in the basin section 44 or in a separate basin section. The same applies if the container device is also to include the containment body D.

Preferably, the concrete used for the casting is high-quality concrete. For the innermost containment body A it may be appropriate to use ore concrete which is advantageous in respect of the casting operation and also in respect of the heat conductivity and thereby the dissipation of heat from the nuclear fuel.

In the above-described method of manufacturing the container device according to the invention, the concrete is cast in the containment bodies from below and upwards, but the casting can also take place in the opposite direction, and it is also possible to feed the concrete and discharge the excess concrete at one and the same end of the containment body, preferably at the upper end. These and other modifications of the container device described above and the method and installation for manufacturing it are within the scope of the invention as defined by the claims.

The invention claimed is:

1. A container device for the long-term storage of hazardous material, particularly for the ultimate disposal of nuclear fuel, comprising at least one elongate, cylindrical first containment body having a casing wall and end walls, the casing wall and the end walls defining a first compartment for accommodating at least one hazardous-material body formed by the hazardous material or containing or supporting the hazardous material, the first compartment comprising support means for supporting the hazardous-material body centrally in the first compartment and spaced from the casing wall and the end walls, an elongate, cylindrical second containment body having a casing wall and end walls, the casing wall and the end walls defining a cylindrical second compartment, the second compartment comprising support means for supporting the first containment body centrally in the second containment body and spaced from the casing wall and the end walls of the second containment body, and passages provided in at least one of the end walls of each of the first and second containment bodies for the introduction of wet concrete in the first and second compartments for filling the space between, as regards the first containment body, the hazardous-material body and the walls defining the first compartment, and, as regards the second containment body, the space between the first containment body and the walls defining the second compartment.

2. A container device according to claim 1, comprising an elongate, cylindrical third containment body having a casing wall and end walls, the casing wall and the end walls defining a cylindrical third compartment, the third compartment comprising support means for supporting the second containment body centrally in the third containment body and spaced from the casing wall and the end walls of the third containment body, and passages provided in at least one of the end walls of the third containment body for the introduction of wet concrete in the third compartment for filling the space between the second containment body and the walls defining the third compartment.

3. A container device according to claim 2, comprising an elongate, cylindrical fourth containment body having a casing wall and end walls, the casing wall and the end walls defining a cylindrical fourth compartment, the fourth compartment comprising support means for supporting the third containment body centrally in the fourth containment body and spaced from the casing wall and the end walls of the fourth containment body, and passages provided in at least one of the end walls of the fourth containment body for the introduction of wet concrete in the fourth containment body for filling the space between the third containment body and the walls defining the fourth compartment.

4. A method for manufacturing a container device for the ultimate disposal of nuclear fuel elements arranged in a fuel assembly, comprising the steps of:

introducing and fixing the nuclear fuel elements in a defined position in an essentially cylindrical container, wherein a length of the cylindrical container is substantially larger than a length of the nuclear fuel elements, and wherein a space is provided between the nuclear fuel elements and between a side and end walls of the cylindrical container, and embedding the nuclear fuel elements throughout the length thereof and at ends thereof in a casting compound which casting compound fills completely the space between the nuclear fuel elements and the side and end walls of the cylindrical container and between the individual nuclear fuel elements, wherein the embedding step includes the steps of forcing the casting compound into the container under a pressure in the range of 10 to 50 bar through one of the end walls, and discharging excess casting compound through one of an opposite end wall or the same end wall.

5. A method according to claim 4, in which the container is in an underwater position during the introduction of the nuclear fuel elements in the container and during the embedding of the nuclear fuel elements in the casting compound.

6. A method for manufacturing a container device for the long-term storage of hazardous material included in an elongate hazardous-material body, comprising the steps of:

placing the hazardous-material body in an elongate, cylindrical first containment body having a casing wall and end walls, and fixing the hazardous-material body in a defined central position in the containment body which is spaced from the casing walls and the end walls of the containment body, embedding the hazardous-material body in the first containment body throughout a length thereof and at ends thereof in concrete, including the steps of introducing the concrete through one of the end walls and causing the concrete to completely fill the space between the hazardous-material body and the inside of the first containment body, placing the first containment body with the embedded hazardous-material body embedded therein in an elongate, cylindrical second containment body having a casing wall and end walls, and fixing the first containment body in a defined central position in the second containment body which is spaced from the casing and the end walls of the second containment body, and embedding the first containment body throughout a length thereof and at ends thereof in concrete, including the steps of introducing the concrete through one of the end walls of the second containment body and causing the concrete to fill completely the space between the first containment body and the inside of the second containment body.

7. A method according to claim 6, comprising the further steps of:

placing the second containment body with the embedded first containment body therein in an elongate, cylindrical third containment body having a casing wall and end walls, and fixing the second containment body in a defined central position in the third containment body which is spaced from the casing and the end walls of the third containment body, and embedding the second containment body in the third containment body throughout a length thereof and at ends thereof in concrete, including the steps of introducing the concrete through one of the end walls of the third containment body and causing the concrete to fill completely the space between the second containment body and the inside of the third containment body.

8. A method according to claim 6, in which the embedding takes place under water.

9. A method according to claim 6, wherein the introducing the concrete into the first containment body through one of the end walls thereof takes place at a pressure of the concrete in the range of 10 to 50 bar.

10. A method according to claim 6, wherein the introducing the concrete into the first containment body through one of the end walls thereof takes place at a pressure of the concrete in the range of 10 to 50 bar, and wherein the introducing the concrete into the second containment body through one of the end walls thereof takes place at a pressure of the concrete in the range of 10 to 50 bar.

11. A method according to claim 7, wherein the introducing the concrete into the first containment body through one of the end walls thereof takes place at a pressure of the concrete in the range of 10 to 50 bar, and wherein the introducing the concrete into the third containment body through one of the end walls thereof takes place at a pressure of the concrete in the range of 10 to 50 bar.

12. A method according to claim 4, in which the casting compound is concrete.

* * * * *